US010363196B2

(12) United States Patent
Planke

(10) Patent No.: US 10,363,196 B2
(45) Date of Patent: Jul. 30, 2019

(54) VIBRATOR APPARATUS FOR USE IN PHYSICAL TREATMENT

(71) Applicant: REDCORD AS, Staubø (NO)

(72) Inventor: Tore Planke, Oslo (NO)

(73) Assignee: Redcord AS, Staubø (NO)

( * ) Notice: Subject to any disclaimer, the term of this patent is extended or adjusted under 35 U.S.C. 154(b) by 662 days.

(21) Appl. No.: 14/914,517

(22) PCT Filed: Aug. 29, 2014

(86) PCT No.: PCT/NO2014/050155

§ 371 (c)(1),
(2) Date: Feb. 25, 2016

(87) PCT Pub. No.: WO2015/030602

PCT Pub. Date: Mar. 5, 2015

(65) Prior Publication Data

US 2016/0206503 A1 Jul. 21, 2016

(30) Foreign Application Priority Data

Aug. 30, 2013 (NO) ..... 20131158

(51) Int. Cl.
*A61H 23/02* (2006.01)
*A61H 1/02* (2006.01)
(Continued)

(52) U.S. Cl.
CPC ..... *A61H 23/0218* (2013.01); *A61H 1/0229* (2013.01); *A61H 1/0292* (2013.01);
(Continued)

(58) Field of Classification Search
CPC ..... A61H 23/0218; A61H 1/0296; A61H 1/0229; A61H 1/0292; A61H 23/0236;
(Continued)

(56) References Cited

U.S. PATENT DOCUMENTS 3,366,749 A 1/1968 Ries
4,064,376 A 12/1977 Yamada
(Continued)

FOREIGN PATENT DOCUMENTS

WO WO 2008/085058 7/2008
WO WO 2010/059061 5/2010
WO WO 2011/042624 4/2011

*Primary Examiner* — Quang D Thanh
(74) *Attorney, Agent, or Firm* — Knobbe, Martens, Olson & Bear, LLP

(57) ABSTRACT

A vibrator apparatus includes a moving coil, which is rigidly attached to a member, e.g. a frame or beam, of a vibration device. The moving coil is for an elected vibration mode of the apparatus configured to receiving electric signals, e.g. pulsating and/or sinusoidal electric signals, from a signal unit. The moving coil co-operates with a permanent magnet, which is suspended by springs attached to the member, and the coil and the magnet are mutually linearly and coaxially movable upon application of electric signals to the moving coil. An actual distance of movement being part of a distance between extreme positions and being less than the axial length of the moving coil. The springs are located at a distance from a respective axial end portion of the permanent magnet.

12 Claims, 10 Drawing Sheets

(51) Int. Cl.

| | |
|---|---|
| ***A63B 21/00*** | (2006.01) |
| ***A63B 7/00*** | (2006.01) |
| ***A63B 21/068*** | (2006.01) |
| *A63B 23/025* | (2006.01) |
| *A63B 23/12* | (2006.01) |

(52) U.S. Cl.
CPC ..... *A61H 1/0296* (2013.01); *A63B 7/00* (2013.01); *A63B 21/00196* (2013.01); *A63B 21/068* (2013.01); *A61H 23/0236* (2013.01); *A63B 23/025* (2013.01); *A63B 23/1236* (2013.01); *A63B 2208/0219* (2013.01); *A63B 2208/0252* (2013.01)

(58) Field of Classification Search
CPC ... A63B 7/00; A63B 21/068; A63B 21/00196; A63B 2208/0219; A63B 23/025; A63B 23/1236; A63B 2208/0252
See application file for complete search history.

(56) References Cited

U.S. PATENT DOCUMENTS

| | | | | |
|---|---|---|---|---|
| 4,710,655 | A * | 12/1987 | Masaki | B06B 1/045 310/30 |
| 2002/0017824 | A1* | 2/2002 | Sakai | B06B 1/045 310/81 |
| 2002/0095103 | A1 | 7/2002 | Blue | |
| 2005/0207609 | A1* | 9/2005 | Oser | A47C 7/72 381/396 |
| 2006/0015045 | A1* | 1/2006 | Zets | A61H 23/0218 601/78 |
| 2006/0094990 | A1* | 5/2006 | Kim | A61H 1/005 601/33 |
| 2010/0063426 | A1* | 3/2010 | Planke | A61H 1/0292 601/46 |
| 2011/0166486 | A1* | 7/2011 | Kumanomido | A61H 23/0236 601/15 |
| 2012/0109029 | A1 | 5/2012 | Ma | |

* cited by examiner

VIBRATOR APPARATUS FOR USE IN PHYSICAL TREATMENT

CROSS-REFERENCE TO RELATED APPLICATIONS

This application is the U.S. National Phase under 35. U.S.C. § 371 of International Application PCT/NO2014/050155, filed Aug. 29, 2014, which claims priority to Norwegian Patent Application No. 20131158, filed Aug. 30, 2013. The disclosures of the above-described applications are hereby incorporated by reference in their entirety.

BACKGROUND OF THE INVENTION

The present invention relates to a vibrator apparatus in a vibration device for physical treatment usage, comprising two mutually movable, co-axially aligned parts and one of the parts being configured to receiving electric signals.

Such vibration equipment is intended to cause that at least one body part of a human being or animal, the body part having at least one reduced or absent function, is subjected to vibration in order to stimulate the body part function.

DISCUSSION OF PRIOR ART

In the human body there are three "systems" which involve neuromuscular control (also named sensory motoric control).

One system is the eyesight system, and another is the vestibularis system in the inner ear. The third one is the proprioceptive system, which consists of mechano-receptors in muscles, tendons, ligaments, capsula articularis, skin and sub-skin tissue.

U.S. Pat. No. 5,101,810A discloses vibration equipment in the form of a chair or a bench which is contact with a person, the body being exposed to low frequency acoustic sound/vibration signals simultaneously with supplying music to the ears of the person, and a component of the music is superimposed onto said low frequency signal. The patent discloses observable positive stimulant in connection with Rett's syndrome, autism, spastic conditions, neck or shoulder pain, lumbago, pre-menstrual pain, asthma, stress-inflicted depression, sport injuries, rheumatism, muscular spasms and general discomfort upon a state of tension.

Equipment of this type or corresponding types can, however, upon such influence not be able to stimulate muscle spools and/or tendon spools to a degree worth mentioning. Muscle-/tendon spools have as a task to signal to the brain the state at any time which the muscular fibers are in, i.e. relaxed, statically contracted, dynamic activity, or whether the muscular fibers are stretched.

The previous inventions of the applicant as described inter alia in EP 1,819,405-B1 and US 2010/0063426-A1 (=NO325,834) disclose vibrations equipment for influencing the proprioceptive system of the body, wherein the equipment with elected vibration frequencies is capable of setting into vibration during specific time periods depending ropes which lowermost are engaging and are loaded by a body part of a person.

By means of such equipment there is provided a method known as Redcord® Neurac®, wherein it is aimed at optimal activation of muscle spools by using body weight as resistance (heavier and heavier) and then supply mechanical vibration to the musculature in order to enhance feedback from muscle spools to the brain via the nerve paths (tractus). This in turn results in increased signal activity out from the brain to the muscular fibers via the nerve paths. Sensational results of treatment from using such equipment have been achieved in connection inter alia with whiplash-injuries, joints having pain and poor mobility and back discomfort, including discus prolapse and ischias.

OBJECTS OF THE INVENTION

However, the applicant has observed that for certain ailments, as e.g. with patients having great movement inhibitions, unbalance or dizziness, often in conjunction with intensive pain, a strong demand for further to challenge and stimulate the proprioceptive system seems to be present.

The present invention has therefore as a task to provide a solution by which such demands are remedied.

According to the invention, it is intended to be able to signal control said vibrator apparatus to produce vibration of stochastic type having at least one frequency, at least one amplitude and at least one defined vibration cycle as parameters, at least one of the parameters having a parameter value electable from one of: stochastically selected value and stochastically varying value.

By the term stochastic is understood here and in the following that the vibration and its at least two parameter values have not pre-determined characteristics and are thus arbitrary or "randomized".

By using vibrator apparatus of a type as e.g. described in the applicants US patent publication 2010/0063426-A1 (=NO 325,834) the creation of vibrations having complex waveforms is possible, but to a limited extent due to severe restrictions when using rotary vibrators. For some of the intended tasks to be carried out, according to the invention, such a known vibrator apparatus can be used, but for more complex waveforms both as regards vibration frequencies, vibration intervals, short reaction time to control signals and a need for variations in vibration strength with a set vibration pattern, it is desirable to have available a type of vibrator which satisfies such needs, simultaneously with being mechanically and electrically simple, as well as cheap, reliable and maintenance free.

These limitations of prior art vibration apparatus are thus intended to be solved by the present invention.

SUMMARY OF THE INVENTION

According to the invention, the vibrator apparatus is characterized in;

that the vibrator apparatus comprises:

- a coil which is rigidly attached to a member of the vibration device, the coil being configured to receiving said electric signals from a signal unit, and
- a permanent magnet which is suspended by springy elements attached said member and is movable relative thereto, and the coil and magnet being linearly and coaxially mutually movable between extreme positions upon application of said signals to the moving coil, an actual distance of mutual movement being part of a distance between said extreme positions and being less than axial length of the moving coil.

Further embodiments of the novel vibrator apparatus to be described later.

By using this novel type of vibrator apparatus, there is obtained significantly improved vibration dynamics of the vibration equipment, as vibrations having complex waveforms, e.g. randomized noise, and even with rapid changes, are enabled in a more efficient and satisfactory manner. Improved vibration dynamics may also be obtained, e.g.

where low frequency sinusoidal signals are superimposed by high frequency signals, irrespective of whether these are e.g. regular signals or randomized signals of band-pass filtered "white noise" type.

Another limitation by using rotary vibrators is that they do not permit variation of vibration intensity without simultaneously changing their frequency of rotation. The present invention enables a simple change of the vibration intensity (signal strength to the moving coil) without changing the vibration pattern.

Also, the invention enables a vibrator apparatus which is mechanically very simple.

It will be appreciated from the subsequent description that the novel type of vibrator apparatus, having improved vibration dynamics and a simple structure, will be of great importance in order to provide a best possible vibration treatment by means of the vibration equipment.

Background of Stochastic Noise or Vibration and Stochastic Resonance, and with Reference to the Invention Even though stochastic noise (or stochastic vibration) and "stochastic resonance" SR are terms which have existed for many decades, still the use of stochastic noise has not led to practical equipment on the market for use in alleviating physical ailments of human beings or animals, and most of that which is described in literature is related only to tests of laboratory type. SR was in fact discovered and proposed for the first time in 1982 in order to explain periodic reappearance of ice ages.

The term "stochastic resonance" SR is in the context related to human beings or animals a mechanism or phenomenon which appears because it is added noise, e.g. vibration, as extra stimuli to reach thresholds for firing nerve cells, with the purpose of stimulating functions which have become inactive or do not react in a normal way. SR, per definition, is a non-linear phenomenon where addition of an arbitrary disturbance (noise) may improve detection of weak stimuli or enhance information contents in a signal, e.g. train of action potentials or signals generated by neuronal composition.

An optimal amount of supplied noise yields maximum improvement, whereas further increases in noise intensity only degrades detectability or information contents.

It is therefore interesting and important to note that too high intensity of stochastic noise (vibration) most often causes deteriorated sensory-motoric signal. Correct level is therefore important. The SR effect appears to have an almost Gaussian characteristic, where too low vibration level or too high vibration level does not provide optimal results. For persons having no specific ailment in a body part, influence of stochastic noise will in some cases give negative effects or have no effect because the transportation of signals is normal.

SR may in individual cases appear even with sinusoidal vibration, i.e. vibration with fixed amplitude and steady vibration, but in the present invention it has been found that stochastic noise in the form of vibration, i.e. e.g. vibration with arbitrary amplitude and uneven vibration cycle, or randomized vibration where frequency, amplitude, vibration time and/or cycle varies in an undefined pattern provides well-defined extra stimulant. The preliminary test results from tests done on a closed group patients having different ailments exhibit sensational treatment results which no type of medication based treatment or traditional physiotherapy treatment yet has been able to exhibit.

The interesting aspect of the treatments which are performed seems to indicate that the treatment provides a long term or permanent positive result. Inter alia, a young man being very handicapped and a wheelchair user, has subsequent to a limited number of treatments regained full walking function. The treatment results are in a process of being systemized and will be further disclosed later.

Tests having been made by the applicant, inter alia tongue tests, exhibit remarkable results before and after treatment, and in using MR measurements it can clearly be observed increased brain activity and shifting of activity centers in the brain. This may indicate that the brain, when conceiving specific stimuli, is capable of reorganizing in order to open signal paths or establish other signal paths or control programs, in order to thereby control body parts which are not optimally influenced.

SR is extensively described in the literature and the reactions which appear are clearly observable, although it is not fully appreciated which mechanisms that are involved and how they co-operate. Research which has been carried out indicates that in order to "cheat" the brain to initiate reactions, it is important that inter alia at least one vibration parameter varies or appears in an arbitrary or unpredictable pattern.

Even though stochastic noise or stochastic resonance are terms which have existed for over 40 years, the use of stochastic noise has still not led to practical devices on the market to be used to remedy physical ailments in human beings or animals.

In the literature there is disclosed that tests performed in a simple manner and to a limited extent have shown that stochastic noise has SR effect in multiple situations, inter alia to prevent tendency to falling (important to prevent femur neck fracture), remedy instability and dizziness of elderly people or patients suffering from diabetes, posture swaying of such people and patients having had a stroke. In such cases, there has during tests been used a stochastically vibratory platform, vibrators attached to ankle portions or below the foot sole, and also auditory noise signals and stimulants by means of electrodes attached to the rear side of the ears.

Patients, in particular elderly who get vibrations (subsensory noise) applied to their feet, obtain significantly better balance and less tendency of swaying and instability, even when standing on one leg. A corresponding tendency is also observed as regards ankle instability, where use of stochastic noise-stimulant results in stochastic resonance and improved stability. US 2008/161734-A1, US2011/271554-A1, US2012/186101-A1 and US2012/222333-A1 disclose some examples of vibratory insoles.

Among other aspects when using stochastic noise can be mentioned that tests, disclosed in the literature, have indicated that a certain level of background noise or "white noise" have positive effect on memory properties and ability of apprehension related to inattentive children, in particular children with ADHD. Such children are often more easily distracted than other children during otherwise normal circumstances. The effect is also somewhat dependent on the individual: External noise (noise outside the nervous system) and internal noise (neural noise related to dopamine-tone). If reduced or damaged dopamine transfer is present, then external noise seems to provide beneficial effect (ADHD). Even though beneficial as regards ADHD, corresponding noise applied to those having normal attention/ability of comprehension may be harmful. Positive observations have also been found with patients having dopamine-related neurodegenerative disturbances, such as akinesia, Parkinson and aging. Dopamine seems to modulate the effect of noise. Studies in this connection have been made at Lund University Cognitive Science, Sweden by Sikström, Söderlund and Smart.

In particular task-irrelevant noise has been found to provide positive effect, e.g. traffic noise. Stochastic noise (randomized noise) seems to provide positive results. The noise contributes to raising a signal which is below auditory threshold, and the signal thereby becomes detectable. Too low or too strong noise level will not necessarily provide result, but in certain cases attenuate the signal. Such use of stochastic noise may e.g. be used to improve hearing for persons having reduced hearing or have cochlea implant. The basic concept is that multiple sources of unpredictable variability in fibers in the hearing nerve in case of normal hearing is known to be absent in deaf ears. The hypothesis is therefore that a finely controlled, arbitrary component in the feed-out of cochlea implant electrical signals may stimulate nerve fibers in a more natural way and which can lead to improved hearing.

*The FASEB Journal express article* 10.1096, 3 Dec. 2002 indicates that application of vibration of low magnitude to a large degree improved formation of bone as a reaction to loading, which may indicate that stochastic resonance can contribute to osteogenic reaction.

*Journal of wound care vol.* 19, no 3, March 2010 indicates that stochastic "white noise" which was applied to ulcus pepticum (which is difficult to heal) during 60 consecutive days, reduced the surface area of said ulcus pepticum by a total average closing rate of 82.5%

*Journal Appl. Physiology* 2008, October 107(4)-1017-1027 discloses that stochastic mechano-sensoric stimulation may stabilize immature respiratory patterns of pre-maturely born children, inter alia apnea and hypoxia.

Another interesting study is how stochastic noise influences a living creature is e.g. the observation of a so-called "paddlefish" (polyodon spathula) in a swimming mill between two parallel plate electrodes which emit a noise field with a frequency 0.5-20 Hz. In this case, the fish managed to detect considerably more food than without such a noise field present.

Stochastic phenomena in the body therefore seem to have greater importance that what has been known before, and that stochastic resonance therefore may have importance both as regards development of illness and healing functions. SR therefore seems clearly to have importance for intercell-communication.

*The Development of a noisy brain*. McIntosh, Kovacevic, Lippe, Garrett, Grady; *Jirsa-Archives Italiennes de Biologie,* 148: 323-337, 2010) concludes by indicating that the maturing changes in brain noise represents the improvement of functional network potential, i.e. the dynamic repertoire.

Testing of noise in human muscle spools indicates the possibility that fusimotor-systems use a stochastic resonance-type mechanism in order to increase the sensitivity of muscle spools to stretch. It is known that fusimotor activity and muscle spool output is improved in the course of postural tasks and new movements.

*The Effects of Stochastic Resonance Stimulation on Spine Proprioception and Postural Contol in Chronic Low Back Patients* (Reeves, Cholewicki, Lee ogMysliwiec, *Spine, vol.* 34, no. 4, pp. 316-21, 2009), states that test results show that SR stimulation of paraspinal muscles improves posture control, but this improvement can hardly be credited to improved spinal proprioception. Persons with compromised neuro-muscular control or those subjected to instable environments may have benefits from SR-stimulation.

Wikipedia discloses that stochastic resonance has been observed in the neural tissue in sensory systems of multiple organisms. SR has yet to be explained completely as regards biological systems, but neural synchronism in the brain (in particular in Gamma wave frequency) has been proposed as a possible neural mechanism for SR by researchers which have investigated "sub-conscious" visual experience.

The invention is now to be more closely explained with reference to the attached drawing figures, these figures illustrating non-limiting embodiments of the apparatus according to the invention.

DETAILED DESCRIPTION OF THE INVENTION

As mentioned in the introduction, it is through the inventive ideas and testing thereof found that the concept on which the present invention is based and that by using the novel type of vibrator apparatus provides possibility for improved results of treatment of ailments which are not easily cured by means of known medication, surgery and/or traditional physiotherapeutic treatment. As mentioned, some ailments are treatable in a god manner using method and equipment of Redcord® Neurac®, as inter alia disclosed in US 2010/0063426-A1.

Figure 3:
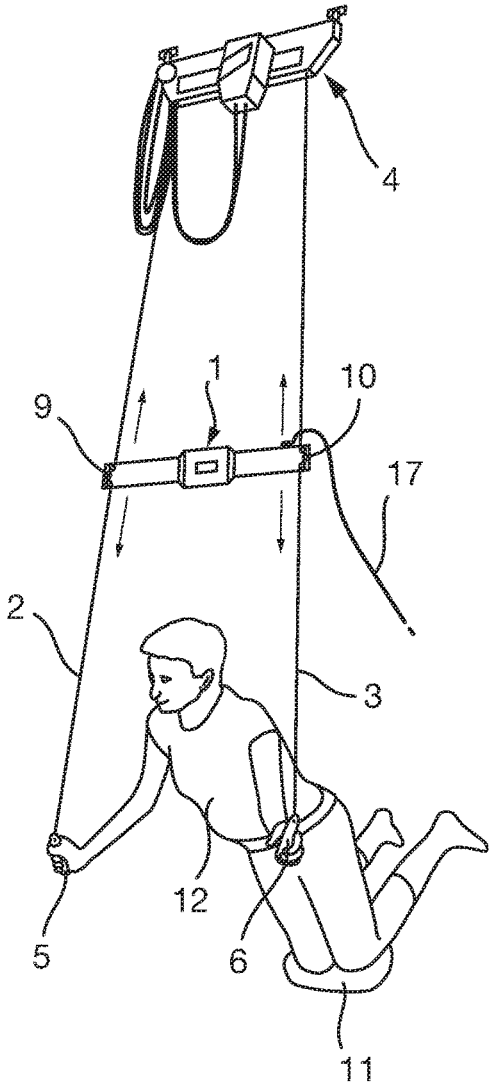
FIGS. 3 and 4 show non-limiting usages of the vibrator apparatus with a vibration device housing or cover suspended by and extending between two depending ropes.
Figure 4:
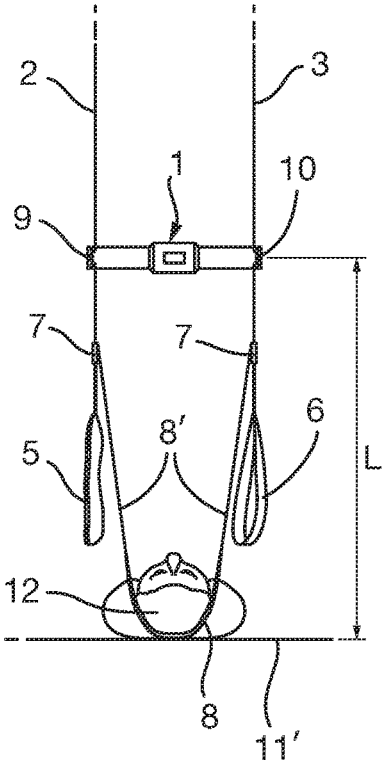

The present invention has as outset been tested with particularly good and from medical view highly interesting and sensational results by using vibration equipment in the form of a vibration device 1 which is suspended between a pair of ropes 2, 3 extending from a training/exercise apparatus 4 known as "Redcord® Trainer" by means of which the length of the ropes depending therefrom is easily adjustable. The ropes 2, 3 may lowermost end in e.g. gripping straps 5, 6 as shown on FIG. 3 or be attached by means of gripping pieces 7 to a sling 8 via sling straps 8', as shown on FIG. 4.

Even though the invention in an embodiment is specifically referred to in using the vibration beam together with a pair of ropes, it will be appreciated that the invention is in no way limited to such a use, and that another type of equipment to transfer vibrations to a human being or an animal using the means which the invention are directed to, will lie within the scope of the invention, and which an expert in the art through guidance from the invention may put to practice. Although the invention is in particular described in connection with the use of a vibration beam, it is of course possible to use the vibrator apparatus in a different manner, e.g. installed in a vibration frame.

The vibration device 1 is attachable to the ropes 2, 3 in releasable manner through use of gripping devices 9, 10. In a currently preferred embodiment of the gripping devices they each consist of three locking studs 9', 9", 9'" and 10', 10", 10'" which the ropes are passed by in a wavy pattern and thereby attaches the vibration device 1 to the ropes 2, 3. This is shown in a somewhat enlarged view on FIGS. 6*a* and 6*b*. In this manner, the vibration beam 1 may be attached at a required location along the length of the ropes, so that there is a specific distance L from a base 11; 11' on which a person 12 rests, e.g. on a bench for treatment. The chosen distance L will also be decisive for the fraction of vibration energy, from the vibration device 1 and transferred to the ropes 2, 3, which will reach the person 12. The larger the value of L, the lesser the energy transfer.

Figure 6A:
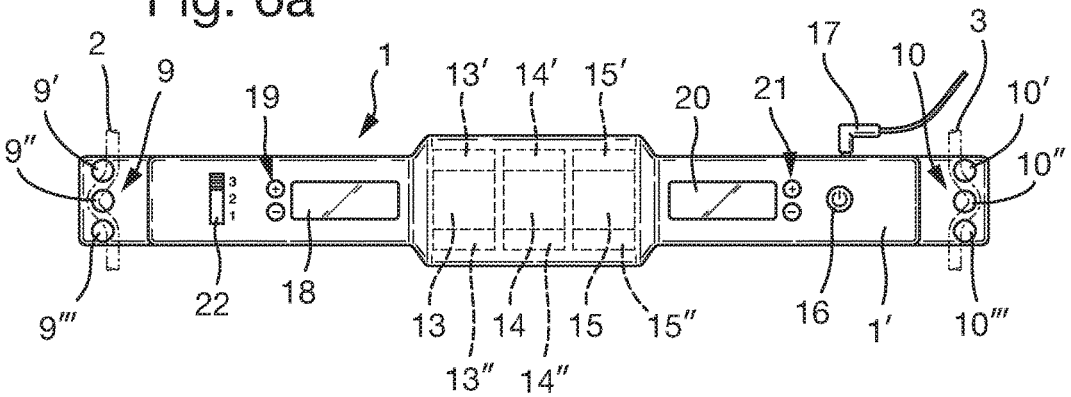
FIGS. 6*a* and 6*b* show known vibration equipment, according to the previous invention by the applicant, as shown inter alia in US 2010/0063426-A1, as seen in front view and from above, respectively.
Figure 6B:
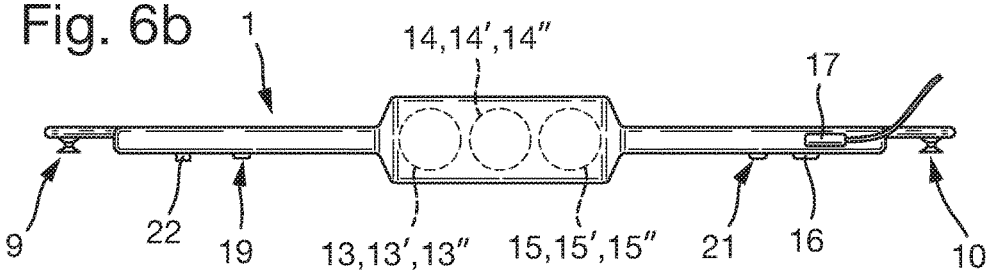

As shown on FIG. 6*a*, the vibration device 1 has a housing or cover 1' and inside it there is located, as previously known from US 2010/0063426-A1, a vibrator apparatus which consists of three vibrators in the form of electric motors 13, 14, 15 which are configured via their respective rotary drive shaft to move associated rotary, eccentrically supported weights 13', 13"; 14', 14"; 15', 15". An on/off switch 16 for a cable 17 of power supply is located on the housing or cover 1'. The vibration device 1 may e.g. be provided with display panels 18, 20 which in the known embodiment shows e.g. frequency and duration, respectively, and where election options are controlled by selection buttons 19, 21.

Figure 12:
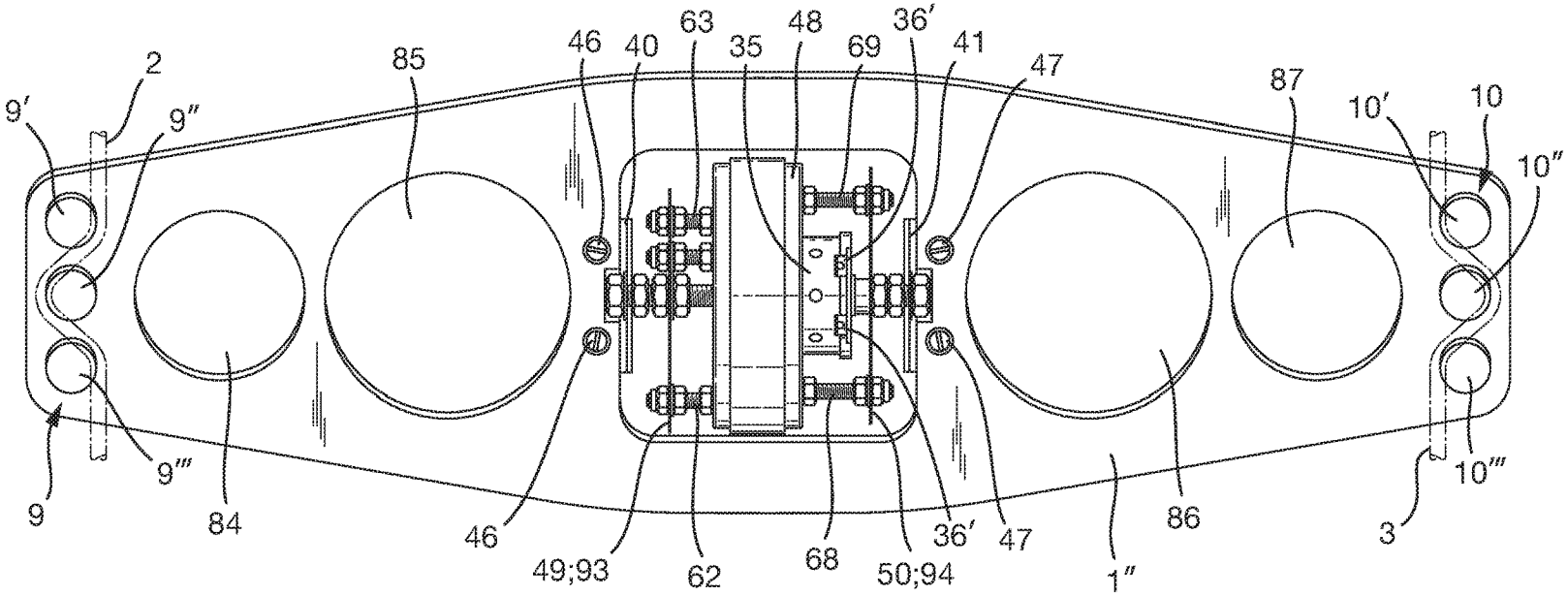
FIG. 12 shows an inside view of the vibration device, without a protective housing installed, with the novel vibrator apparatus mounted on a vibration frame or beam, and with the use of suspension springs as shown on either FIG. 8 or FIG. 9.
Figure 13:
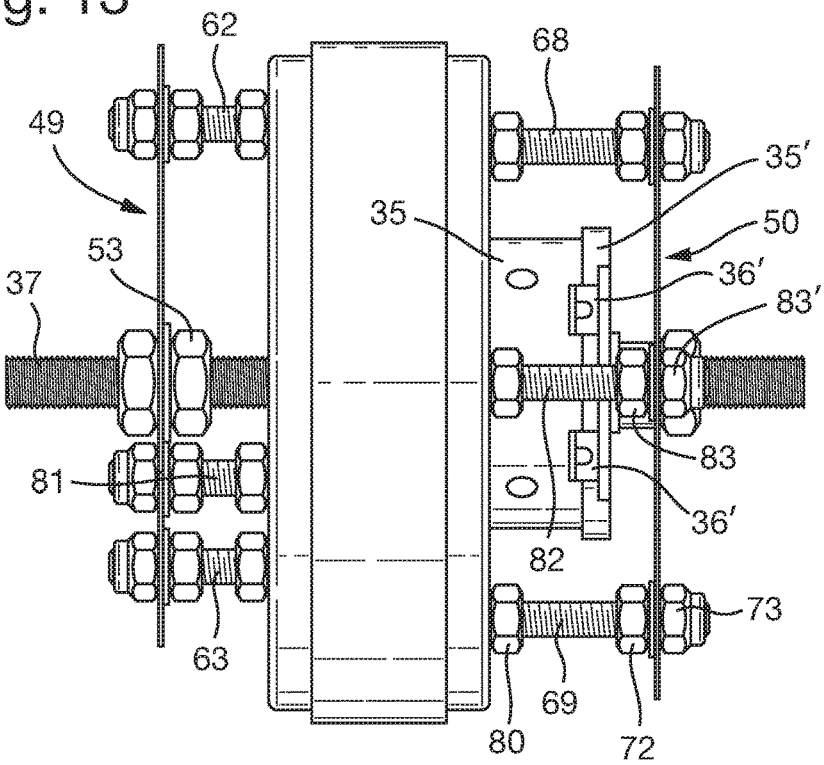
FIG. 13 shows the vibrator apparatus viewed from one side and with suspension springs of a type shown on FIG. 8.
Figure 14:
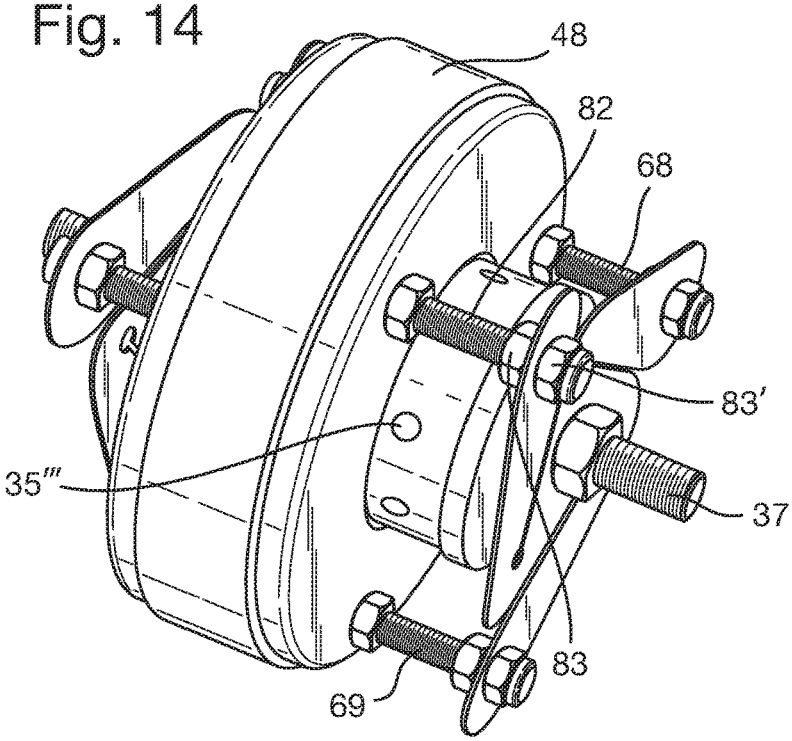
FIG. 14 shows the vibrator apparatus in perspective view, viewed from the moving coil side of the apparatus, and with suspension springs of the type shown on FIG. 8.
Figure 15:
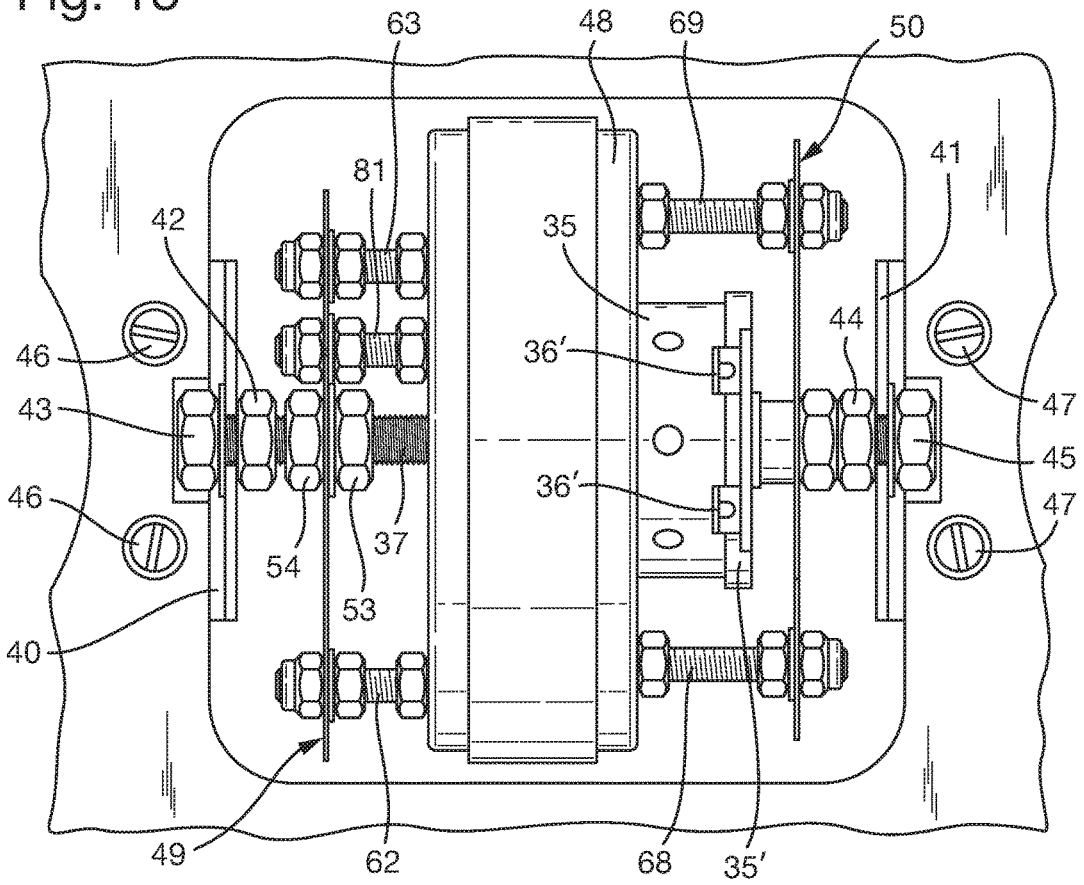
FIG. 15 shows an enlarged view of the vibrator apparatus shown on FIG. 12 and with suspension springs of the type shown on FIG. 8.
Figure 16:
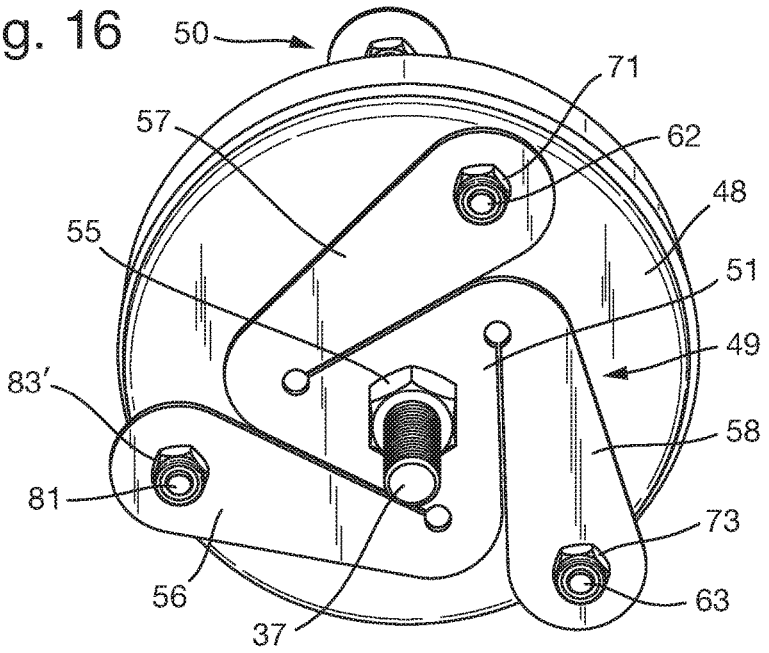
FIG. 16 shows the vibrator apparatus viewed from the permanent magnet side of the apparatus and with suspension springs of the type shown on FIG. 8.

Intensity settings can e.g. be controlled by means of a selection button 22 which may also control how many of the vibrators inside the housing of the vibration beam are to operate simultaneously. These display panels and selection buttons are in the context of the present invention only examples, as it is possible to visualize that the display panels instead show the selected operation modes, e.g. selected from the selection options: a1, a2; b1, b2; c1, c2; d1, d2; e1, e2; f1, f2; g; h, and that it will be sufficient with one display panel 24, e.g. of "touch screen" type, as indicated as an example on FIG. 2. Corresponding display panel may of course be present on a member 1" of the vibration device 1, the member e.g. being a vibration frame or vibration beam 1" (FIG. 12), although not shown on that drawing figure. FIG. 12 shows as an example the vibration frame or vibration beam 1" without a surrounding protective housing or cover 1' (see FIG. 2). However, in practical use and to avoid any body injury to an operator or user, and to protect the vibrator apparatus from damages, such protective housing or cover 1' should be installed on the vibration frame or beam 1".

If the vibration device 1 provides possibility for remote control from a remote control unit 23, the remote control unit may have a display 23' displaying the selected vibration modes. Whether these chosen vibration modes are shown in clear-text, graphics or in codes is immaterial relative to the contents of the invention. Transfer of control signals from the remote control unit 23 to the vibrator in the vibration device 1 will normally take place through use of cable due to a relative large power requirement, but it will also be possible with wireless signal transfer if the vibration device is equipped with sufficient battery capacity.

Alternatively, the remote control 23 may, instead of a customized device, e.g. consist of a PC, a laptop, a network-pad or a smart-phone. The advantage thereof is a simpler up-grading of software which is to control the vibrator apparatus. This aspect will be further described in connection with the attached FIG. 2.

Figure 1:
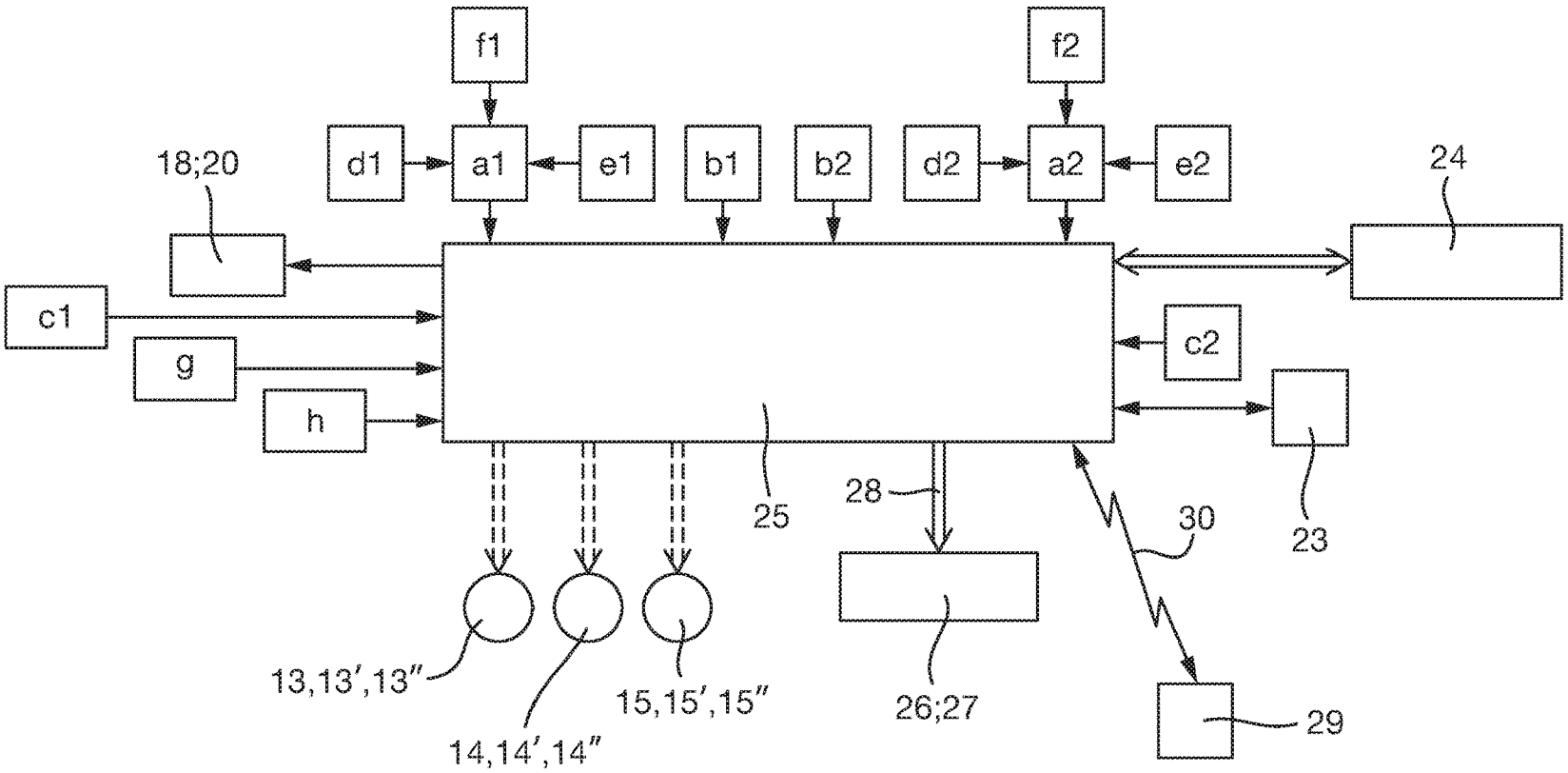
FIG. 1 shows a simplified principle block schematic of a vibration equipment, where the vibrator apparatus, according to the invention, is included.

As shown on FIG. 1 there is provided a signal unit 25, e.g. consisting of a signal processor and a power amplifier. A power amplifier is normally required to provide sufficient signal power to the vibrator apparatus, irrespective of whether the vibrator apparatus is of traditional type as shown and explained in connection with FIGS. 6*a* and 6*b*, or of a novel type as shown and explained in connection with FIGS. 7-18.

Figure 2:
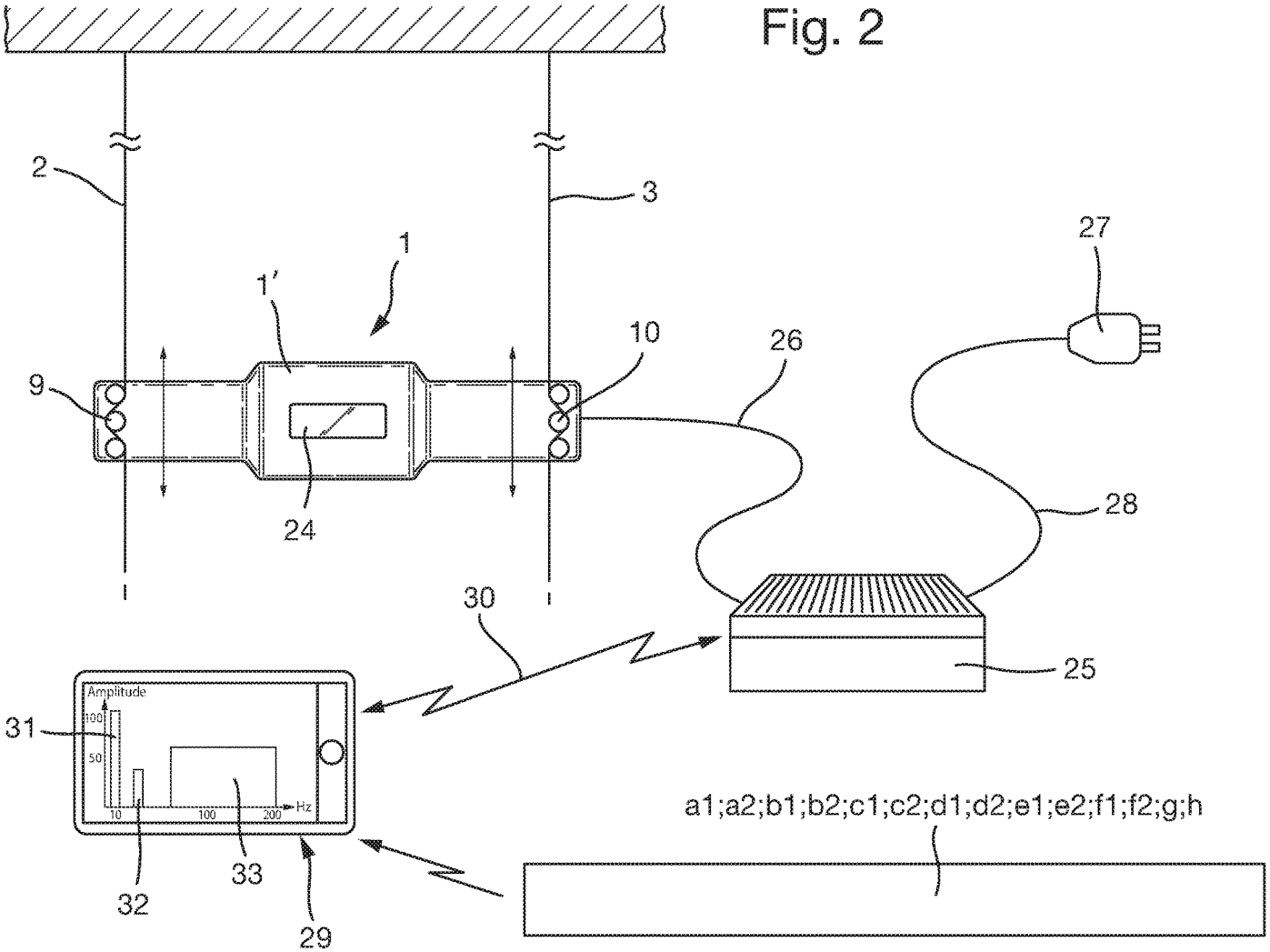
FIG. 2 shows in a sketch manner a solution for controlling the vibrator apparatus, e.g. when included in vibration equipment, such as a vibration beam or frame which is selectable attachable to a pair of ropes, or such as a vibration frame.
Figure 5:
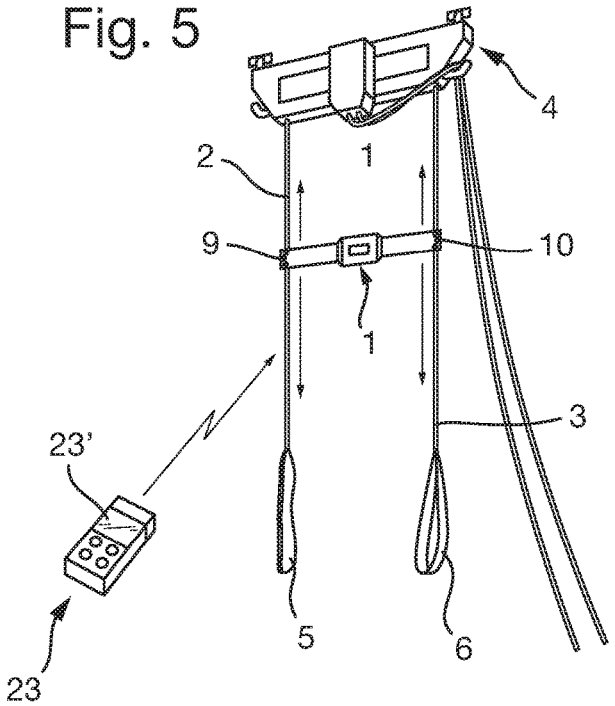
FIG. 5 illustrates remote control option and position shifting of a vibration device which includes the vibrator apparatus, according to the invention.

On FIG. 2 there is shown a variant of the solution on FIG. 5, where the vibration device 1 is suspended between a pair of ropes 2, 3 and is supplied with control signals via a signal cable 26 from a signal unit 25 which contains a signal generator, power amplifier and safety electronics, and where the signal unit has a power supply module which is connected to a mains plug 27 via a power cable 28. A smart-phone, an internet-pad or a PC or other data processing equipment serves suitably as a remote control unit 29 and may communicate with the signal unit 25 in wireless 30 fashion (e.g. via "Bluetooth") or via cable.

The advantage of the solution on FIG. 5 is that all control of the vibration device 1 is from the remote control unit 29 to the signal unit 25, and without a requirement that there is to be present within the housing 1' (e.g. a cover) of the vibration device 1 other means than the vibrator apparatus 34 of the moving coil type attached to a frame 1" or beam 1" inside the housing 1'. It is thus not necessary to have any electronics, display etc. located inside or on the housing 1' of the vibration apparatus, yielding that this device becomes simpler and cheaper, simultaneously with avoiding that such electronic equipment is exposed to frequent vibrations.

There is on FIG. 2 shown a non-limiting example of use for operational mode, where the reference numerals 31, 32 denote single frequencies with indication of signal strength and 33 denotes frequency range of stochastic noise with indication of signal strength.

Frequency spectra can be set by pulling up, by means of a forefinger on a display on the unit 29, desirable frequencies to a required signal strength, 100% being maximum. It will also be possible to select many independent frequencies each having individual signal strength. If the stochastic noise (white noise) is to be superimposed the fixed frequencies, this can be elected by e.g. using two fingers on the display to indicated the frequency range (band-pass filtered) and then pull this field up to required signal strength.

The previously mentioned possible operational modes a1, a2; b1, b2; c1, c2; d1, d2; e1, e2; f1, f2; g; h and combinations thereof will therefore be able to form at least part of the possible applications that may be established on the unit 29.

It will be appreciated that with an intention to offer provision of complex vibration patterns to a vibration equipment, a traditional vibrator apparatus as e.g. known from US 2010/0063426-A1 may have limitations as regards vibration dynamics, and also upon need for vibrations where the strength or intensity is to be varied, while e.g. vibration frequency varies/vibrations frequencies vary. In many cases, such a prior art vibration device may be functional for a selection of desirable of possible operational modes, but not necessarily where multiple or certain operational modes are to be present simultaneously.

Because it is intended with a vibrator apparatus of the present invention to provide vibration of stochastic type with at least one frequency, at least one amplitude and at least one defined vibration cycle as parameters, at least one of the parameters having a parameter value which is selected from one of: stochastically selected value and stochastically varying value, there have to be set strong requirements on the capability of such a vibrator apparatus to handle composite vibration control signals in an efficient, simple and cheap manner, while taking care of vibration dynamics in an excellent manner.

As an example of what requirements that will have to be set to such a vibrator apparatus, it is set as a pre-condition that it inter alia must be able to react in a satisfactory manner to the signal control from the vibration control signal unit 25 to the vibrator apparatus when the signal control exhibits one property feature, i.e. one operational mode, from at least two of the following features a)-c):

a) a1) causing current vibration frequency to be elected selectively or arbitrarily from the vibration range 10-150 Hz, or
   a2) electing at least two mutually different vibration frequencies from the range 10-150 Hz to selectively or arbitrarily appear simultaneously,
b) b1) causing duration of the vibration to vary arbitrarily from 0.5 to 10 seconds, preferably 0.5-5 seconds, or
   b2) causing duration of the vibration to vary arbitrarily in constant intervals of elected duration from 0.5 to 10 seconds, preferably 0.5-5 seconds,
c) c1) causing the intervals between the vibrations to vary arbitrarily from 1 to 10 seconds, preferably 1-5 seconds, or
   c2) causing the intervals between the vibrations to vary in a predetermined manner from 1 to 10 seconds, preferably 1-5 seconds.

When the signal control comprises at least feature a1), the signal unit 25 may in addition, according to an elected, supplementary operational mode d1), cause the vibration delivered by the vibrator apparatus to jump as regards duration or frequency and to be superimposed on or be co-operative with stochastic noise.

When the signal control comprises at least feature a2), the signal unit 25 may in addition, according to an elected, supplementary operational mode d2), cause the vibrations delivered by the vibration apparatus and having different frequencies to jump as regards duration or frequency/frequencies and to be superimposed on or be co-operative with stochastic noise.

When the signal control comprises at least feature a1), the signal unit 25 may in addition, according to an elected, supplementary operational mode e1), cause the vibration strength of selectively or stochastically elected frequency delivered by the vibrator apparatus to be changed from vibration interval to vibration interval.

When the signal control comprises at least feature a2), the signal unit 25 may in addition, according to an elected, supplementary operational mode e2), cause the vibration strength or respective vibration strength of the selectively or stochastically elected frequencies delivered by the vibration apparatus, to be changed from vibration interval to vibration interval.

When the signal control exhibits at least feature a1), the signal unit 25 may in addition, upon an elected, supplementary operational mode f1), cause the vibration strength of selectively or stochastically elected frequency delivered by the vibration apparatus to be changed steadily or stochastically during the course of a vibration interval.

When the signal control exhibits at least feature a2), the signal unit 25 may in addition, upon an elected, supplementary operational mode f2), cause the vibration strength or respective vibration strength of the selectively or stochastically elected frequencies delivered from the vibrator apparatus, to be changed steadily or stochastically during the course of a vibration interval.

Within the scope of the present invention, there is the possibility that the signal unit 25, according to any elected operational mode(s), upon election of another supplementary operational mode g) may cause that the vibration apparatus delivers, stochastically or at predetermined different times, vibration stimuli or vibration stimuli in co-operation with stochastic noise.

There is also a possibility, within the scope and concepts of the invention, to let the signal unit 25, according to any elected operational mode(s), upon election of another supplementary operational mode h), cause the vibration of stochastic type delivered by the vibrator apparatus to co-operate with a vibration having a constant low frequency in the range 5-60 Hz, preferably 10-20 Hz.

Based on these considerations with regard to high requirements to vibration dynamics to be placed on a vibrator apparatus, there is thus provided through the invention a novel, low-cost vibrator apparatus being technically simple and robust in its structure, both mechanically and electrically.

Details of the novel vibrator apparatus are now to be further described with reference to FIGS. 7-18.

Figure 7:
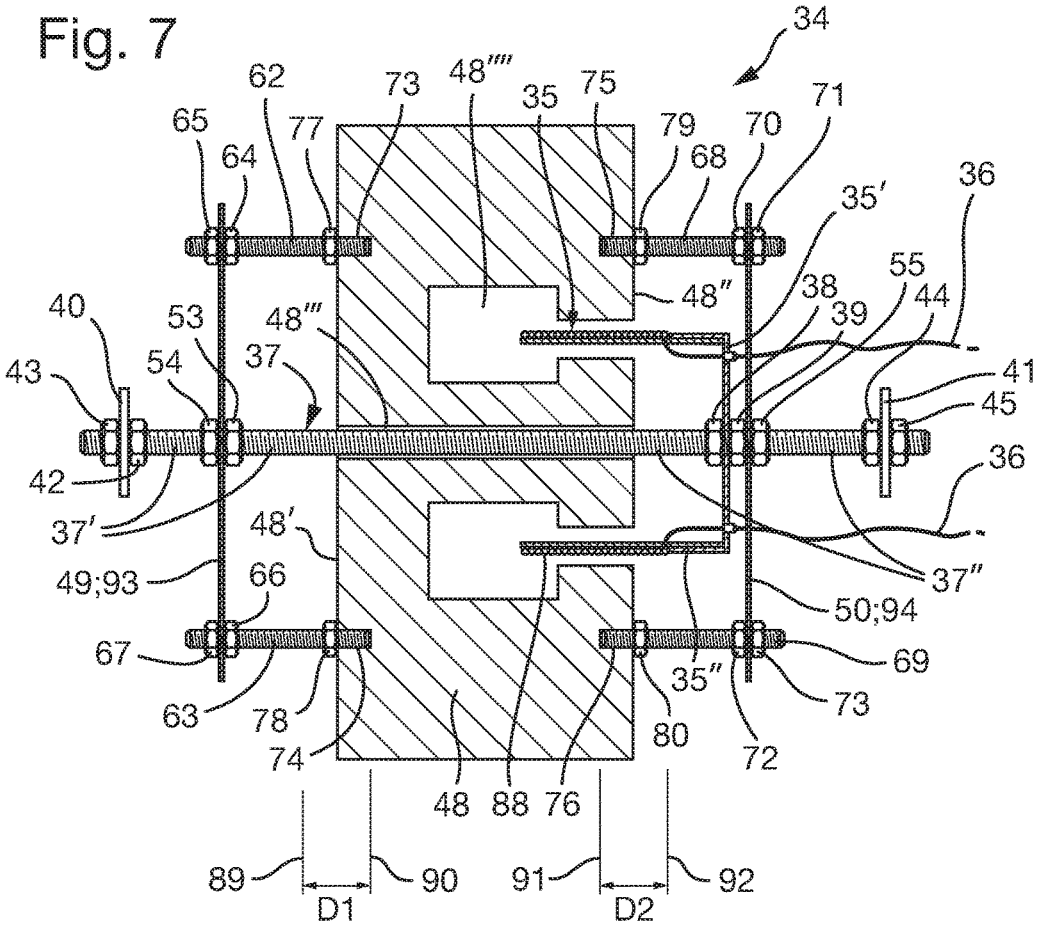
FIG. 7 is a principle sketch of the novel vibrator apparatus, according to the invention, which is included in the vibration device.

FIG. 7 shows a principle sketch of the novel vibrator apparatus 34, shown without being installed on a vibration frame or vibration beam 1" (see FIG. 12). The vibrator apparatus 34 is in principle a moving coil mechanism consisting inter alia of a moving coil 35 in interaction with a permanent magnet 48. The moving coil 35 has connection wires 36 and which may be further connected to a signal cable 26, see FIGS. 1 and 2, or the cable 17 as shown on FIGS. 3-6 serving here as a signal power cable. The moving coil 35 is in the shown embodiment fixedly attached to a shaft 37 which at least at its end regions 37', 37" has threads. The moving coil 35 has an end piece 35' which can be fixedly attached to the shaft 37 by means of nuts 38, 39. The nut 38 could instead possibly be a sleeve which is unitary with the end piece 35'.

The shaft 37 extends through an axial, central channel 48'" of a permanent magnet 48 and axially through the moving coil 35, and the shaft 37 may at its extreme ends, i.e. at its end regions 37', 37", be fixedly attached to fittings 40, 41 by means of nuts 42, 43 and 44, 45. The fittings 40, 41 are in turn attachable to the frame or beam 1" by means of e.g. screws 46, 47 (see FIG. 12) or rivets.

In addition, the vibrator apparatus consists of the permanent magnet 48 which at its axial end regions 48', 48" is connected to a flat suspension spring 49, 50 with legs (see FIGS. 7, 8 and 12-18) or a substantially flat, circular disc shaped spring 93; 94 (see FIGS. 7 and 9-12). The spring is e.g. made from phosphorus bronze, i.e. a non-magnetic material.

Figure 8:
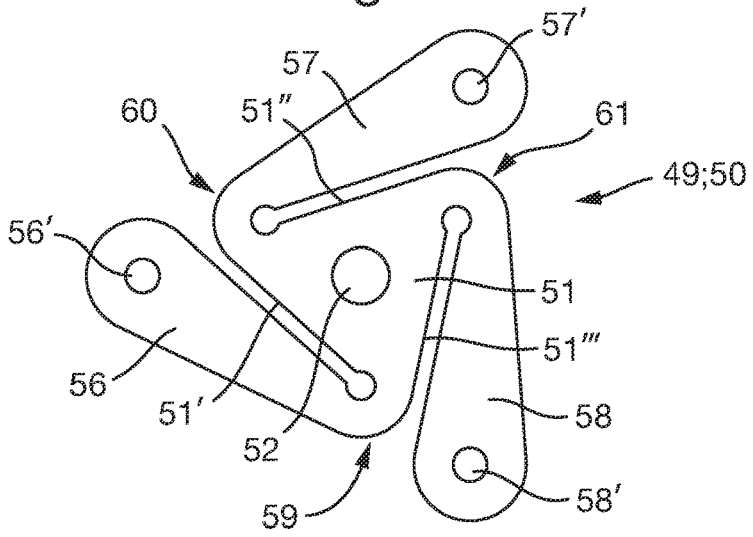
FIG. 8 shows as an example a configuration of a suspension spring which the vibrator apparatus has a pair of, according to the invention.

Further details of the springs 49, 50 will appear from FIG. 8. In a currently preferred, but non-limiting embodiment of the invention, the spring 49; 50 has an approximately triangular, central portion 51 with an attachment hole 52 for engagement with the shaft 37 through use of attachment nuts 53, 54 at the end region 37' and the nut 39 and a nut 55 at the end region 37". Each of the springs 49, 50 has in the shown embodiment three legs 56, 57, 58 which extend with at least a part of its length from a respective corner region 59, 60, 61 on the central portion 51 and along a respective side 51', 51", 51'" of the central, triangular portion 51. It will be noticed that the corner regions have both a curved inside and outside, which is important feature to reduce stress regions which otherwise could result in fractures due to fatigue.

At the free end region of each leg 56, 57, 58 there is provided a respective hole 56', 57', 58' which is configured for engagement with a respective one of rod shaped, threaded spacers 62, 63, 81; 68, 69, 82 being attached in the permanent magnet 48 through use of e.g. attachment nut or adhesive.

On FIG. 7 there is shown how e.g. the legs 57, 58 via the respective hole 57', 58' enter into such engagement with the rod shaped, threaded spacers 62, 63 as regards the spring 49 and are attached onto the spacers by means of nuts 64, 65 and 66, 67, respectively. In a corresponding manner for the spring 50 it is shown how e.g. the legs 57, 58 via the respective hole 57', 58' enter into engagement with rod shaped, threaded spacers 68, 69 and are attached to the spacers by means of nuts 70, 71 and 72, 73, respectively.

It will be appreciated that all three spacers 62, 63, 81 and 68, 69, 82 (see FIGS. 13 and 14) are to be used, and that the hole 56' on the leg 56 of the springs 49, 50 will engage the spacers 81, 82 respectively and be attached thereto by means of nuts. A similar approach applies for the springs 93, 94 and their engagement with said respective spacers via holes 96" on these springs, as will be explained in connection with FIGS. 7 and 9-12.

As mentioned before, the respective spacers 62, 63, 81 and 68, 69, 82 are attached in the permanent magnet 48, and for the spacers 62, 63, 68, 69 shown on e.g. FIG. 7 this preferably takes place in threaded holes 73, 74, 75, 76, respectively. In the currently preferred embodiment there is used tensioning nuts 77, 78, 79, 80 to secure stable thread engagement in these holes. Alternatively there could be used an adhesive to secure thread engagement. Similar approach will of course apply for the spacers 81, 82.

Spacer for engagement with hole 56' on the leg 56, and attachment nuts in this connection are for sake of clarity not shown on FIG. 7, as the shaft 37 and the attachment nuts located thereon have been given priority of illustration. However, the attachment of the springs 49, 50 clearly appears inter alia on FIGS. 13-16 and will be more closely commented on in that context.

It is of course possible to visualize that the springs 49, 50 may have a different appearance, e.g. with differently located legs, or with e.g. four legs instead of three. However, the embodiment on FIG. 8, i.e. with three legs, has according to tests proved to provide a simple and stable structure safeguarding good radial stability, simultaneously with providing intended flexibility in axial direction. It is thereby obtained optimal operational possibilities for the mutual co-operation between the moving coil 35 and the permanent magnet 48 with the purpose to provide both simple and complex vibration patterns. The moving coil 35 obtains, through the permanent magnet 48 using such suspension springs 49, 50, an extremely stable, radial relation to the permanent magnet 48 when there is a mutual reciprocating movement axially between the moving coil 35 which is fixedly attached to the beam or frame 1" and the permanent magnet 48 which is suspended on the beam or frame 1".

There is on FIG. 12 shown how the vibrator apparatus 34 may be installed on the beam or frame 1". The permanent magnet 48 may preferably have larger mass (i.e. weight) than the beam or frame 1", and in order to obtain this the beam or frame should be made as lightweight as possible through choice of suitable material and by removing material which does not affect the rigidity and structural strength of the beam or frame 1",e.g. by using holes 84, 85, 86, 87 therein. Such a configuration will essentially imply that the magnet 48 will have an inertia substantially larger than the combined inertia of the coil 35 and the beam or frame 1", resulting in that upon application of an electric signal to the coil 35, the coil 35 and the frame or beam 1" will move more easily than the much heavier magnet 48.

On FIGS. 13-16 appear inter alia said spacers 81, 82 which can be used to connect the leg 56 on the spring 49, 50 by means of attachment nuts, e.g. 82, 83 for the spring 50, in the same manner as shown and described for the spring legs 57, 58.

Figure 17:
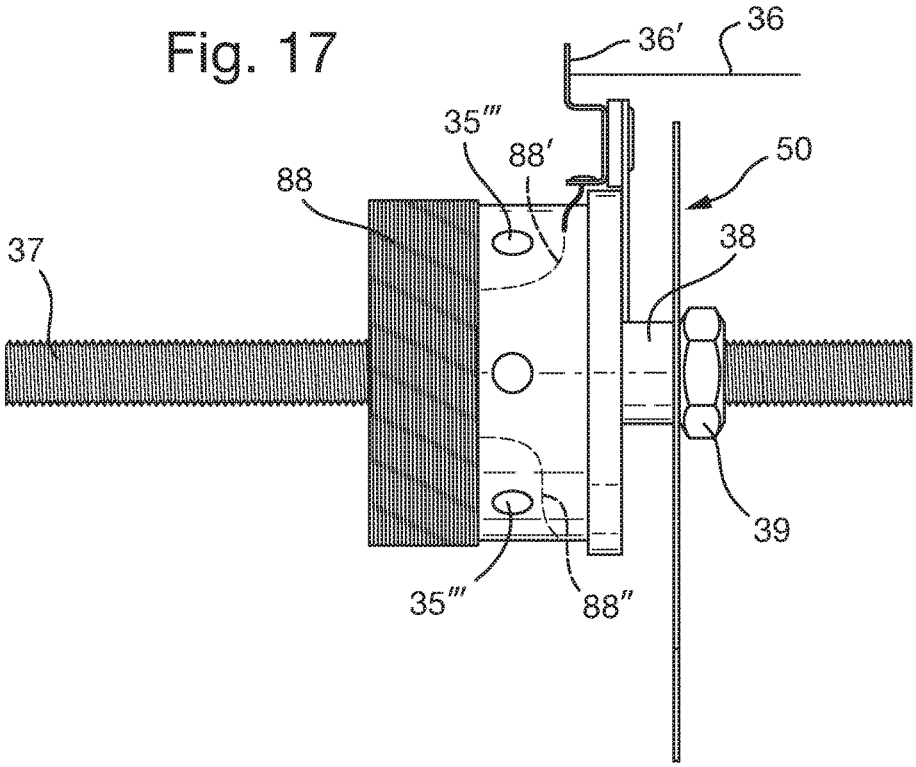
FIG. 17 shows the moving coil part of the vibrator apparatus viewed from one side and with a suspension spring of the type shown on FIG. 8 or 9.
Figure 18:
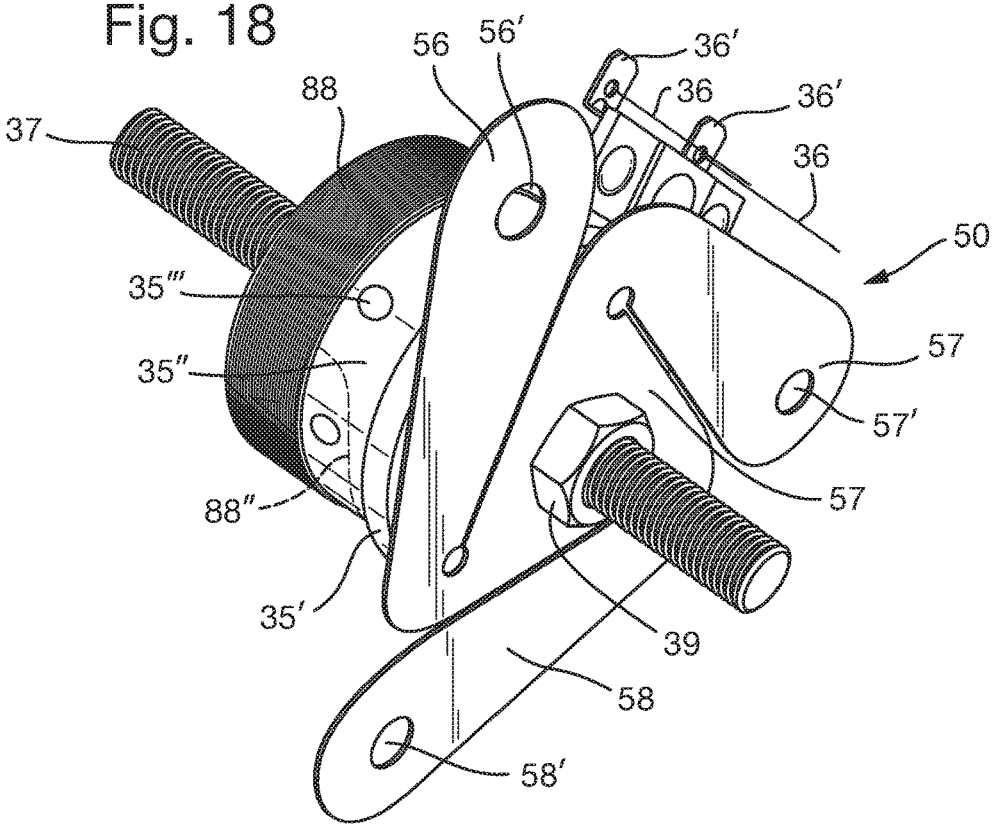
FIG. 18 shows the moving coil part of the vibrator apparatus in a perspective view and with a suspension spring of the type shown on FIG. 8.

A further and brief description of the moving coil 35 will now appear with reference to FIGS. 17 and 18.

Connecting wires 36 to the moving coil 35 are connected to coil windings 88 via a respective wire terminal 36' and coil wires 88', 88". The moving coil 35 has its end piece 35' fixedly attached to a sleeve 35" about which the coil windings 88 have been wound. Vents 35'" are located in the sleeve 35" to ventilate away pressure build-up inside the sleeve 35" when the moving coil 35 moves relative to cavity 48'" in the permanent magnet 48.

A spring type being an alternative to that shown on FIGS. 7, 8 and 12-18 is shown on FIGS. 7 and 9-12. An optionally useable stiffening ring 98 for an outer edge region 96' of a spring 93; 94 appears from FIG. 11.

In this alternative solution the spring tensioning of the permanent magnet 48 relative to the frame 1" or beam 1" takes place by using the spring 93; 94 located at a distance from a respective end of the permanent magnet 48. As shown and described in connection with the spring-type 49; 50 as shown on FIG. 8, a central portion 95 of each spring 93; 94 is rigidly attached to the frame in the same manner as shown and explained for the embodiment shown on FIG. 8. This implies that the shaft 37 extends through a centrically located hole 95' in the spring 93; 94. From the central portion 95 there extends a spring material face 96 which at its outer edge region 96' via holes 96" can be rigidly connected with a respective end portion of the permanent magnet 48 via at least three spacers 62, 63, 81 and 68, 69, 82, respectively and associated attachment nuts, as shown and explained in connection with the previously described type of spring 49; 50.

The spring material face 96 has wavy regions 97 with circular ridges 97' and valleys 97" alternately in radial direction and being coaxial with the center hole 95' on the central portion 95.

The outer edge region 96' may optionally be made stiffer using at least one ring 98 which thereby can also be connected with the axial end portions of the permanent magnet 48 via holes 98' on the ring 98 and said spacers 62, 63, 81 and 68, 69, 82, respectively, with associated attachment nuts. Optionally, the outer edge region 96' and the ring 98 may be attached to each other along one surface of the ring, e.g. by using adhesive, soldering or riveting. Although not shown on the drawings there may optionally be located such a ring against either face of the outer edge region 96'.

Also for this alternative embodiment of the spring 93; 94, the central portion of each spring is rigidly attached to the shaft 37 in the same manner as described for the spring 49; 50, and where the shaft 37 extends through an axial, central channel 48'" in the permanent magnet 48 and axially and centrically through the moving coil 35, the shaft 37 at its ends being rigidly attached to the frame or beam 1", as previously described.

As explained for the spring 49; 50, it is of advantage that the spring 93; 94 is preferably made from a non-magnetic material, e.g. phosphorous bonze, and where the ridges 97' and valleys 97" have been created through use of e.g. a press die process.

The permanent magnet 48 is also movable relative to the beam or frame 1" and is thus configured to co-operate with the moving coil 35 which is non-movable relative to the beam or frame 1", and the permanent magnet 48 which in this manner is supported to be axially movable, and radially non-movable, will thereby move linearly and coaxially relative to the moving coil 35 between extreme positions 89, 90 for the end of the permanent magnet 48 which is farthest away from the moving coil 35 and between extreme positions 91, 92 for the end of the permanent magnet 48 which is closest to the moving coil 35. The distance D1 between the positions 89, 90 and the distance D2 between the positions 91, 92 are equal, which implies that a real distance of movement for the permanent magnet 48, relative to the beam or frame 1' and the coil 35, is part of the distance between the extreme positions 89 and 92, is less than the axial length of the moving coil 88, and in reality D1=D2, i.e. so far as the springs 49, 50; 93, 94 permit axial movements of the permanent magnet 48 relative to the moving coil 35. As indicated above, due to the permanent magnet 48 having much larger weight and thereby much larger inertia than those of the combination of the coil 35 and the beam or frame 1", there is a mutual movement of the magnet 48 and the combination of the coil 35 and the beam or frame 1', however yielding that said combination moves more easily than the permanent magnet 48.

Figure 9:
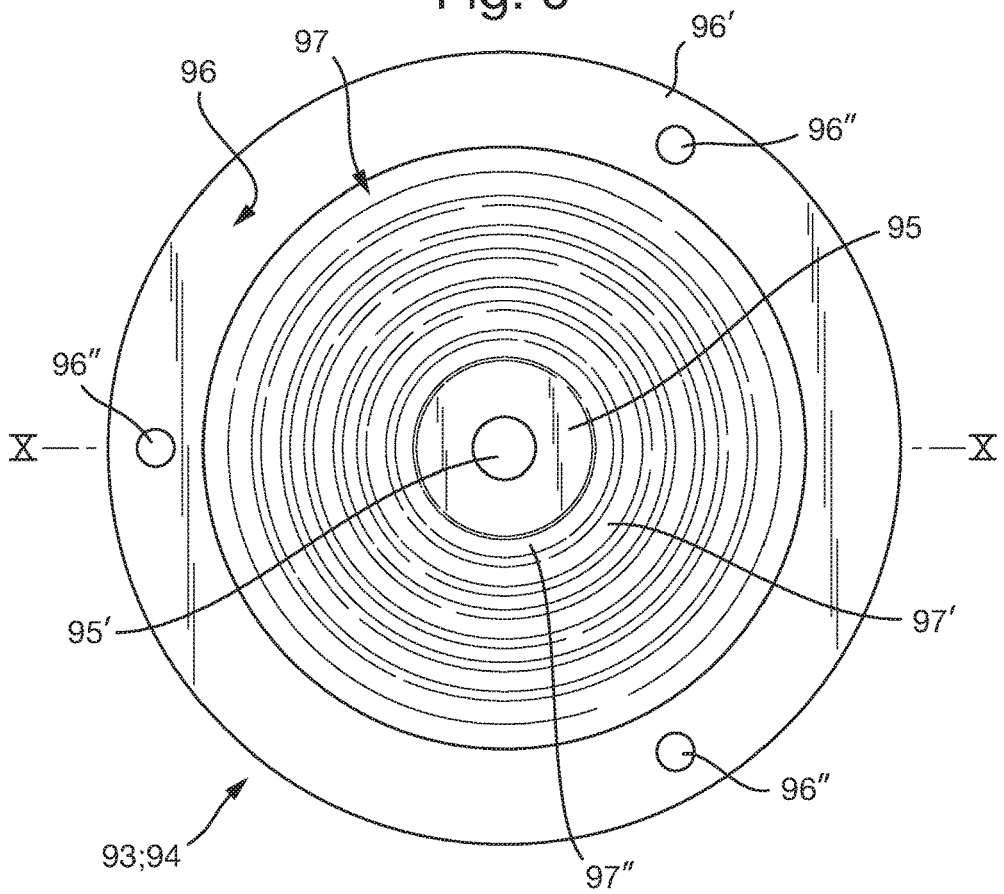
FIG. 9 shows as an example a configuration of an alternative suspension spring, relative to the spring of FIG. 8, and which the vibrator apparatus has a pair of, according to the invention.
Figure 10:
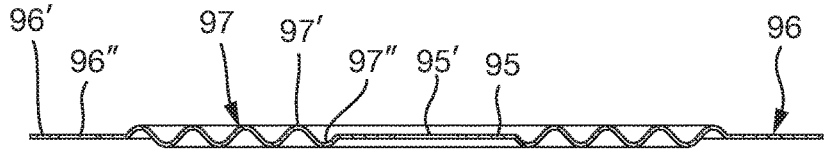
FIG. 10 shows section X-X on FIG. 9.
Figure 11:
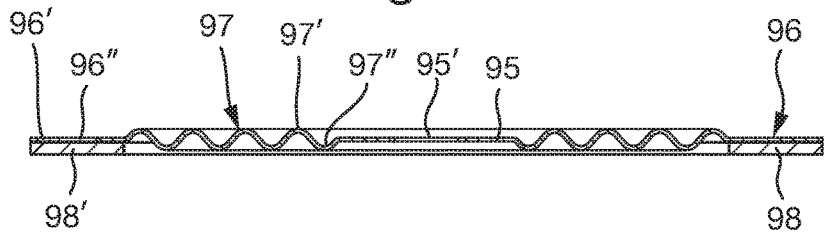
FIG. 11 illustrates use of a peripheral supportive ring for use with the suspension spring shown on FIG. 9.

The advantage of this novel embodiment of the vibrator apparatus of the moving coil type, irrespective of electing the spring type as shown on FIG. 8 or the spring type as shown on FIGS. 9 and 10, is that it allows for vibrations having complex wave shapes, e.g. randomized noise. Similarly, it will be simple to superimpose high frequency signal onto low frequency sinusoidal movements, e.g. either regular signal or randomized signals of the type of band filtered "white noise". In addition it will be easy to vary intensity (signal strength) without changing the vibration pattern. This implies that for a vibration device which is e.g. to act on a pair of ropes which lowermost are gripped by a user or engage body part(s) of the user, the adjustment of vibration strength or intensity is not dependent on having to move the vibration device up or down along the ropes to a desired location of attachment thereat. In some cases it may, however, due to other or specific reasons be desirable to adjust the distance between the vibration device and the user, as e.g. indicated on FIGS. 3 and 5, although this is not to be construed as a limiting aspect of the invention.

With limited hi-fi quality, the vibrator apparatus is also capable of reproducing music and/or speech in connection with or together with vibrations having complex waveforms or other signals as indicated above.

If the shaft 37 and/or each of the spacers 62, 63, 81; 68, 69, 82 has a rod part and only threads at either end, and where the rod part optionally has a larger diameter than the diameter of the threads, and the diameter of the hole(s) 52; 56', 57', 58' or 95'; 96" through which the threaded part is to pass, it may be possible to avoid a fixing nut on the side of the springs which faces the permanent magnet 48.

As shown on FIG. 1, there are present multiple vibration options, all dependent on the type of treatment which is to be performed to obtain a best possible and optimal result of treatment. For a particular patient it may be realistic using not only one type of treatment as regards vibration mode, but rather successive treatments of different type.

As mentioned in the introduction it is important that the vibration equipment, i.e. the vibration beam 1, the ropes 2, 3 and the straps 5, 6 or the sling 8, 8' as in the example, are configured to interact with at least one body part of a human being or animal. When the body part in this manner interacts with the vibration equipment and is subject to vibration, there is present a possibility to stimulate the body function.

As shown and explained in connection with FIG. 5 it is there indicated that the remote control unit 23 may, as an alternative to a customized apparatus, e.g. consist of a PC, a lap-top, an internet pad or a smartphone which communicates with the vibration device/vibration equipment 1. It may be visualized that there may be a direct communication between the remote control unit and the vibrator apparatus in the equipment 1.

The advantage of using said alternatives instead of a customized device is that there may be provided a large number of user applications, so-called "app's", where the most actual ones thereof may be present as different, fixed set-ups and which are adapted to different protocols of treatment. Such applications will in a quality control manner be downloadable by the users of the vibrator apparatus via the internet from an applications supplier, e.g. Redcord AS, or be delivered in a different manner.

It will be appreciated that in using a device according to the invention, it is possible to apply to a body part stochastically or at predetermined different times, vibration stimulants or vibration stimulants in co-operation with stochastic noise.

However, the device may also be configured to apply simultaneously to a plurality of body parts stochastically or at predetermined different times, vibration stimulants or vibration stimulants in co-operation with stochastic noise.

Further, it has been uncovered that best treatment effects are obtainable if the device is configured to deliver said application of vibration to the body part(s) in question when the body part(s) being subjected to static or dynamic loading.

Even though the invention has been shown and described in relationship to usage with a vibration equipment or device 1 configured to influence a pair of ropes, it is within the scope of the invention to be able to influence one or more body parts through using the vibrator apparatus with vibration equipment or device of another type than that shown and described here.

What is claimed is:

1. A vibrator apparatus in a vibration device for physical treatment usage comprising:

a coil which is configured to rigidly attach to a member of the vibration device, the coil being configured to receive electric signals from a signal unit, and a permanent magnet suspended by springy elements which are configured to attach to said member and is movable relative to the member, wherein the coil and the permanent magnet are co-axially aligned, and wherein the permanent magnet is linearly and coaxially mutually movable relative to the coil between extreme positions being farthest away from the coil and between extreme positions being closest to the coil upon application of said electric signals to the coil, and an actual distance of movement for the permanent magnet, relative to the coil, is less than axial length of the coil, wherein the springy elements which provide tensioning and suspension of the permanent magnet relative to said member are provided by using a pair of springs located at a distance from a respective axial end portion of the permanent magnet, wherein a central part of each spring is configured to be rigidly connected to the member, wherein from each central part there extends a spring material face which at its radially outer edge region is rigidly linked to said respective axial end portion of the permanent magnet, and wherein the spring material face at its outer edge region is fixedly linked to the respective axial end portion of the permanent magnet at least at three locations having a space therebetween by respective spacers.

2. The vibrator apparatus according to claim 1, wherein the outer edge region is made rigid by means of at least one ring which is linked with the respective axial end portion of the permanent magnet via said respective spacers.

3. The vibrator apparatus according to claim 1, wherein the central part of each spring is rigidly attached to a shaft which extends through an axial, central channel in the permanent magnet, and axially and centrally through the coil, and wherein the shaft at its ends is configured to rigidly attach to said member of the vibration device.

4. The vibrator apparatus according to claim 1, wherein the pair of springs are made from a non-magnetic material.

5. The vibrator apparatus according to claim 4, wherein the non-magnetic material is phosphorous bronze.

6. A vibrator device comprising the vibrator apparatus according to claim 1, wherein the vibrator apparatus is located inside a housing or cover of the vibration device.

7. The vibrator device according to claim 6, wherein ends of said member of the vibration device comprise a plurality of studs configured to engage a pair of hanging ropes.

8. The vibrator device according to claim 6, wherein an inertia induced by a weight of the permanent magnet is substantially larger than an inertia induced by a combined weight of the coil and the member of the vibration device.

9. The vibrator device according to claim 6, wherein said signal unit is configured to deliver to the coil said electric signals as at least one of pulsating and sinusoidal signals.

10. The vibrator device according to claim 9, wherein said electric signals provided from the signal unit are at least partly of a stochastically selected value or a stochastically varying value.

11. The vibrator device according to claim 6, wherein said member of the vibration device is a frame or beam.

12. A vibrator in a vibration device for physical treatment usage comprising:

a coil which is configured to rigidly attach to a member of the vibration device, the coil being configured to receive electric signals from a signal unit, and a permanent magnet suspended by springy elements which are configured to attach to said member and is movable relative to the member, wherein the coil and the permanent magnet are co-axially aligned, and wherein the permanent magnet is linearly and coaxially mutually movable relative to the coil between extreme positions being farthest away from the coil and between extreme positions being closest to the coil upon application of said electric signals to the coil, and an actual distance of movement for the permanent magnet, relative to the coil, is less than axial length of the coil, wherein the springy elements which provide tensioning and suspension of the permanent magnet relative to said member are provided by using a pair of springs located at a distance from a respective axial end portion of the permanent magnet, wherein a central part of each spring is configured to be rigidly connected to the member, wherein from each central part there extends a spring material face which at its radially outer edge region is rigidly linked to said respective axial end portion of the permanent magnet, and wherein the spring material face has wavy regions with circular ridges and valleys alternately in radial direction and being co-axial with a center on the central part.

* * * * *